US005201195A

United States Patent [19]

Gavlak et al.

[11] Patent Number: 5,201,195

[45] Date of Patent: Apr. 13, 1993

[54] BI-FLOW RECEIVER/DEHYDRATOR FOR REFRIGERATION SYSTEM

[75] Inventors: Michael A. Gavlak, Buffalo; Ardeean Scoccia, West Amherst, both of N.Y.

[73] Assignee: General Motors Corporation, Detroit, Mich.

[21] Appl. No.: 873,851

[22] Filed: Apr. 27, 1992

[51] Int. Cl.[5] ..... F25B 43/00; F25B 43/04

[52] U.S. Cl. ..... 62/475; 62/474; 210/DIG. 6; 55/178; 55/387

[58] Field of Search ..... 62/475, 474, 503; 210/282, DIG. 6; 55/178, 387, 389, 462, 464, 465, 52, 159

[56] References Cited

U.S. PATENT DOCUMENTS

| | | | |
|---|---|---|---|
| 3,178,022 | 4/1965 | Balogh | 210/DIG. 6 X |
| 3,310,176 | 3/1967 | Ziherl et al. | 210/DIG. 6 X |
| 3,734,296 | 5/1973 | Proctor et al. | 210/DIG. 6 X |
| 4,029,580 | 6/1977 | Lange | 210/DIG. 6 X |
| 4,072,615 | 2/1978 | McConnell | 62/474 X |
| 4,236,381 | 12/1980 | Imral et al. | 62/503 |
| 4,262,492 | 4/1981 | Morita et al. | 62/324.6 |
| 4,266,405 | 5/1981 | Trask | 62/324.4 |
| 4,320,000 | 3/1982 | Lange et al. | 210/DIG. 6 X |
| 4,496,378 | 1/1985 | Kish | 62/503 |
| 4,838,040 | 6/1989 | Freeman | 62/475 |
| 4,912,937 | 4/1990 | Nakamura et al. | 62/503 X |
| 4,954,252 | 9/1990 | Griffin et al. | 210/282 X |
| 5,038,582 | 8/1991 | Takamatsu | 62/474 |
| 5,051,116 | 9/1991 | Mattsson | 55/52 |

FOREIGN PATENT DOCUMENTS

| | | | |
|---|---|---|---|
| 563974 | 4/1931 | Fed. Rep. of Germany | 62/126 |

*Primary Examiner*—Henry A. Bennet
*Assistant Examiner*—Christopher B. Kilner
*Attorney, Agent, or Firm*—Ronald L. Phillips

[57] ABSTRACT

A receiver dehydrator for a refrigeration system for heating and cooling accommodates flow in either direction. It comprises a canister with openings near the top for coupling to refrigerant lines, and tubes inside the canister extending from the openings to tube mouths at the bottom of the canister for either intake or withdrawal of liquid. A baffle between the mouths allows liquid passage from either mouth to the other but inhibits flow of gas bubbles. The baffle has many perforations for liquid flow and an inclined vane outside each opening directs rising bubbles away from the perforations to encourage migration to the top of the canister. Alternate perforations have vanes on opposite sides of the baffle for gas-liquid separation in either flow direction. A desiccant bag between each tube mouth and the baffle further aids in such migration.

5 Claims, 2 Drawing Sheets

FIG 1
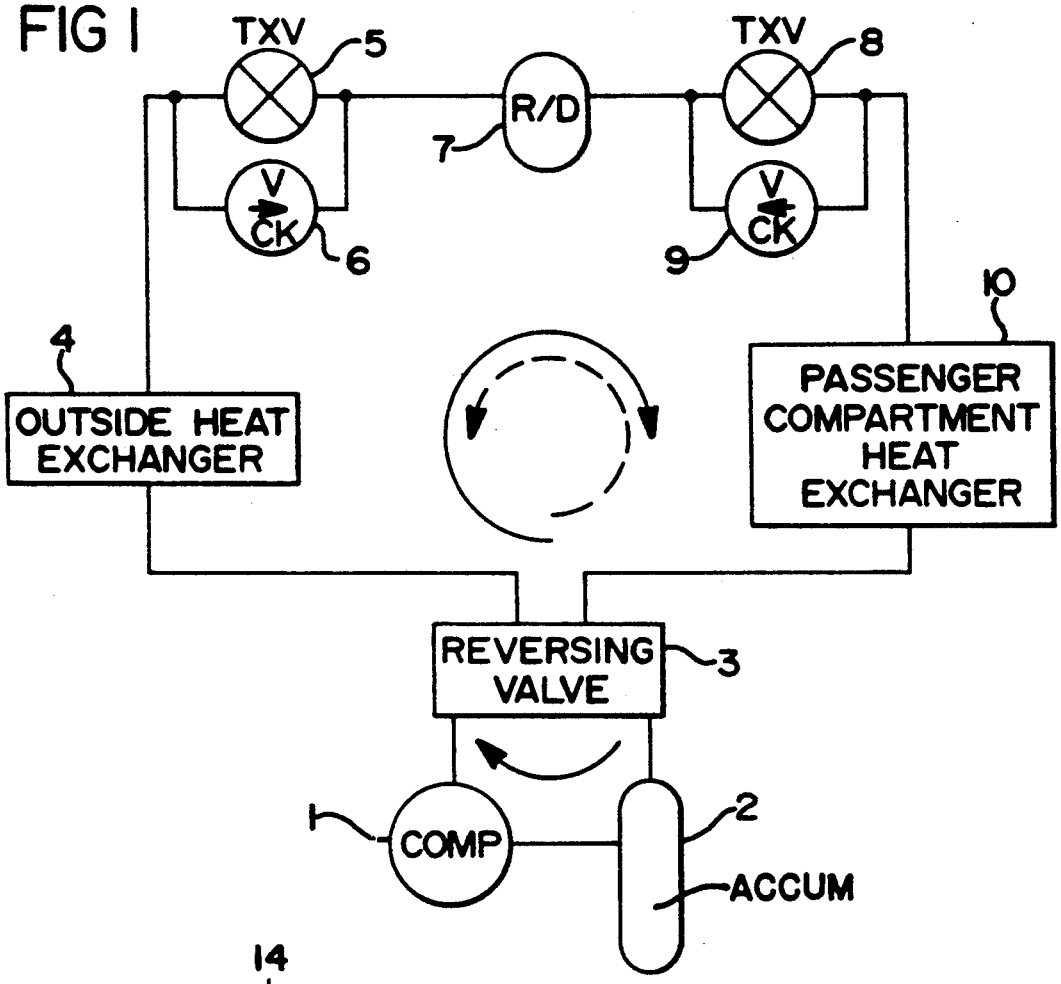
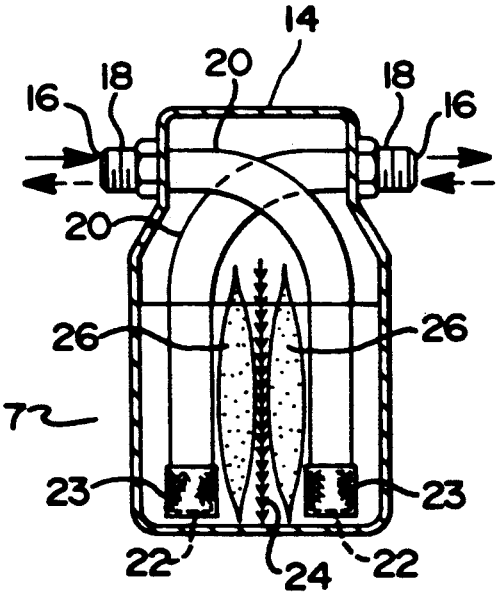
FIG 2
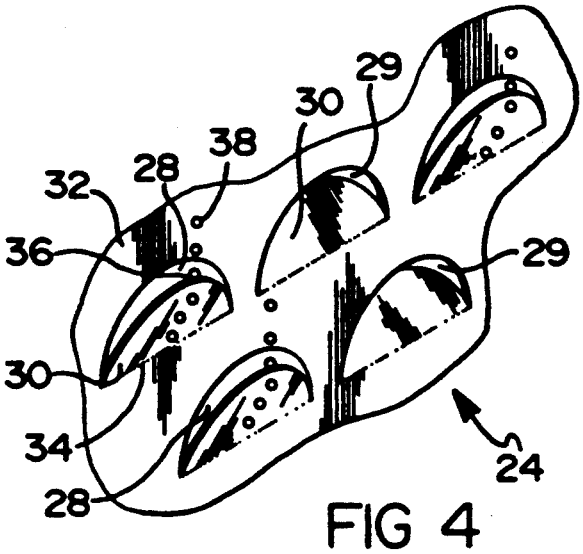
FIG 4

BI-FLOW RECEIVER/DEHYDRATOR FOR REFRIGERATION SYSTEM

FIELD OF THE INVENTION

This invention relates to a liquid-gas separator and particularly to such a separator for refrigeration systems which have refrigerant flow in both directions.

BACKGROUND OF THE INVENTION

Refrigeration systems or heat pumps may use a thermostatic expansion valve which requires that the valve be supplied with a solid column of liquid refrigerant with no gaseous bubbles. Such systems when designed for use on automotive vehicles commonly include a receiver comprising a reservoir which receives refrigerant in the form of mixed liquid and gas phase and separates the phases prior to dispensing the refrigerant. Such reservoirs often contain a desiccant to remove water from the refrigerant and then are known as receiver dehydrators. Usually these devices accommodate fluid flow in only one direction. For such unidirectional flow receivers a number of gas-liquid separation schemes have been proposed. For example, an incoming gas and liquid mixture enters the top of the reservoir so that the liquid can settle to the bottom and the outgoing liquid is drawn from the bottom.

In a system having both heating and cooling modes the direction of refrigerant flow is reversed in a portion of the system to change modes. That bidirectional part of the system includes the receiver and thus a gas-liquid separation receiver operable in both flow directions is needed. Such a receiver requires a separator or baffle which also will function in both flow directions.

SUMMARY OF THE INVENTION

It is therefore an object of the invention to provide for a heating and cooling refrigeration system a gas-liquid separating reservoir for accommodating fluid flow in both directions.

The invention is carried out in a heat pump system selectably operable in heating and cooling modes wherein refrigerant flows through the system in either direction, by a receiver for flow of refrigerant in either direction comprising: a canister for receiving and dispensing refrigerant; first and second passages leading into the canister, each passage having a mouth near the bottom of the canister for discharging refrigerant and receiving refrigerant, baffle means between the passage mouths for permitting flow of liquid refrigerant from one mouth to another and for separating vapor from the refrigerant, whereby liquid and vapor phase refrigerant flows in through one passage and liquid phase flows out through the other passage.

BRIEF DESCRIPTION OF THE DRAWINGS

The above and other advantages of the invention will become more apparent from the following description taken in conjunction with the accompanying drawings wherein like references refer to like parts and wherein:

FIG. 1 is a schematic diagram of a refrigeration system incorporating the invention;

FIG. 2 is a cross section of a bi-flow receiver dehydrator of FIG. 1 according to the invention;

FIG. 4 is an enlarged isometric view of a portion of the baffle of FIG. 3*b* illustrating its operation.

DESCRIPTION OF THE INVENTION

Figure 3A:
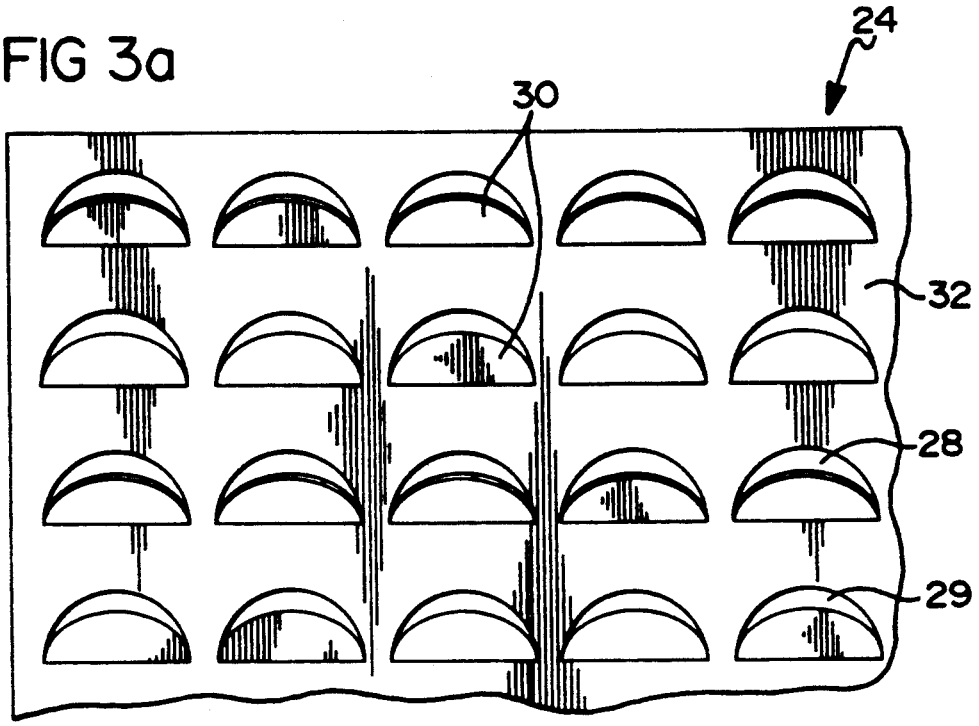
FIGS. 3*a* and 3*b* are side views of two differently patterned baffles for the receiver of FIG. 2 according to the invention.

The ensuing description is directed to a refrigeration or heat pump system which is selectively operable in either heating or cooling mode and which involves the reversal of flow of the refrigerant in at least part of the system. As shown in FIG. 1, the refrigeration system includes a compressor 1 and an accumulator 2 upstream of the compressor coupled to a reversing valve 3, the refrigerant flow being in only one direction as shown by an arrow. On the other side of the valve 3 an outside (or front) heat exchanger 4 is serially connected through a thermostatic expansion valve (TXV) 5 with a bypass check valve 6, a receiver dehydrator (R/D) 7, a TXV valve 8 with a bypass check valve 9 and a passenger compartment heat exchanger 10. When the reversing valve 3 is positioned to direct fluid flow clockwise in the system as shown by a solid arrow, the refrigerant passes from the compressor 1 through the outside heat exchanger 4, the check valve 6, the receiver/dehydrator 7, the TXV 8, the passenger compartment heat exchanger 10 and the accumulator 2 back to the compressor 1 to effect cooling of the passenger compartment. For the heating mode, the reversing valve 3 is changed to cause flow in the counterclockwise direction as shown by the dashed arrow wherein the flow is through the check valve 9 and TXV 5. All the components of the system are conventional except for the bi-flow receiver dehydrator 7 which is shown in the detailed cross section in FIG. 2.

The receiver/dehydrator 7 comprises a canister or reservoir 14 having two openings 16 for inlet and outlet flow of refrigerant to and from the canister 14. The openings 16 are located near the top at opposite sides of the canister 14, and a fitting 18 extends outwardly from each opening 16 for connection to refrigerant lines, not shown. A tube 20 extends inwardly from each opening 16 and terminates at a mouth 22 at the bottom of the canister 14 for intake or discharge of fluid at the bottom. Optionally a screen 23 surrounds the lower end of each tube 20 for filtering out debris which may occur in the system. A baffle 24 between the mouths of the tubes 20 extends across the inner diameter of the canister and extends substantially vertically from the canister bottom to at least half the canister height. Thus for a canister 14 having internal dimensions of 3½ inch diameter and 8 inches in height, the baffle would be 3½ inches wide and at least 4 inches high. Each tube 20 which extends from an opening 16 in one side of the canister to the bottom at the other side of the canister passes over the baffle 24 and crosses the other tube to minimize the tube curvature. A desiccant bag 26 between each tube 20 end and the baffle 24 extends across the canister to separate the tube end from the baffle. Each desiccant bag comprises a fabric envelope filled with pelletized desiccant such as a molecular sieve material. Although it is common practice to include desiccant bags in a receiver to achieve dehydration, in an alternate construction the desiccant bags are omitted. When the desiccant bags are present they help the baffle in performing the liquid-gas separation function. To flow through the canister the fluid must flow in a tortuous path through the desiccant bags in intimate contact with the pellets. Gas entrained in the liquid tends to collect on the rough surface of the pellets to form bubbles which grow as more gas is adsorbed. When large enough the bubbles break away from the pellets and migrate to the surface.

The receiver/dehydrator 7 accepts fluid flow in either direction so that the refrigerant may enter from the left opening and leave at the right, or enter from the right and leave at the left. The liquid level may vary but typically the canister may be two thirds full, and comprises a stream flowing from one tube 20 to the other through and over the baffle. The refrigerant flowing into the canister exits the bottom of a tube 20 at mouth 22 and comprises chiefly liquid but often will have some vapor bubbles entrained in the flow. The purpose of the baffle 24 is to prevent the flow of the bubbles from one tube end to the other so that the fluid withdrawn from the receiver will be liquid only. The baffle construction should be such that as the liquid flows through the baffle, the bubbles will be encouraged to migrate up to the surface of the liquid instead of following the liquid flow through the baffle. The desiccant bags also provide opportunity for the bubbles to escape the liquid flow so that when they are used three stages of liquid-gas separation are present. It is not essential that all the liquid flow through the baffle 24; some flow can take place above the baffle. It is expected that bubbles in that area, near the surface of the liquid, will escape rather than be drawn down to an intake tube mouth 22 at the bottom.

Figure 3B:
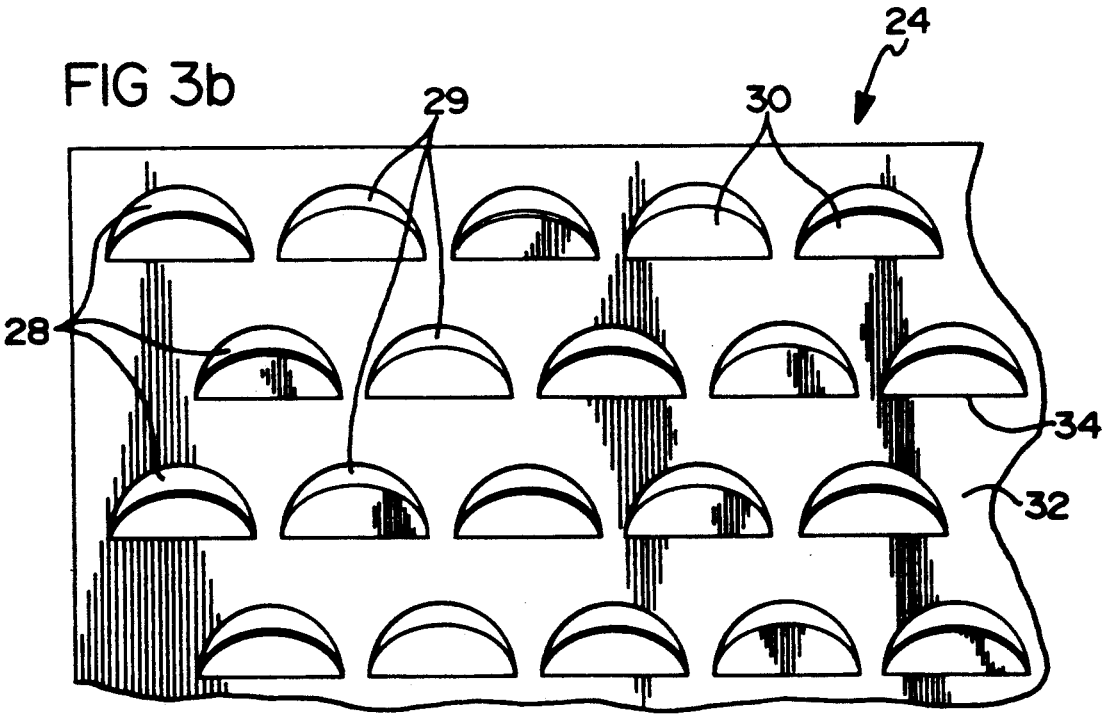

Particular baffles 24 for use in the receiver 7 are shown in FIGS. 3*a*, 3*b* and 4 and comprise a perforated sheet or plate element 32 which may be molded plastic or pressed sheet metal such as aluminum. In either case, the baffle is sized to snugly fit across the diameter of the canister and has two arrays of holes 28 and 29 formed by pressing out vanes or tabs 30, in the case of sheet metal, with vanes 30 extending toward opposite sides of the sheet 32, the holes 28 with vanes extending to one side comprising one array and the other holes 29 comprising the second array. Each vane 30 is attached at its lower edge 34 to the sheet and extends out at an angle, say, 30° to 45°, from the plane of the sheet 32 so that the upper edge 36 is spaced from the sheet. The particular angle and the size and spacing of the vanes depend on the liquid viscosity, surface tension, size of bubbles and fluid velocity. Here it is suggested to form the vanes as semicircles having a radius of ⅛ inch to 1/16 inch with a lateral spacing from adjacent vanes equal to the radius, and the bottom of each row spaced by a similar amount from the top of the next lower row. The diameters of the holes 28, 29 are essentially horizontal and the vanes are joined to the sheet 32 at those diameters.

FIGS. 3*a* and 3*b* show patterns of vanes bent in or out. In FIG. 3*a* each horizontal row has vanes extending in the same direction and adjacent rows have vanes extending in the opposite direction. In FIG. 3*b* the rows are staggered so that each hole (except some end holes) is centered between holes of the next adjacent row and the vanes facing one direction are arranged in zigzag rows alternating with similar rows of vanes facing the other direction.

As indicated in FIG. 4, bubbles 38 in the liquid will tend to migrate up the outside of a vane to the top edge 36 and break free to float upwardly. The liquid flow through the holes 28 is generally horizontal and tends to drag the bubbles in the same direction, but if the liquid viscosity and velocity are sufficiently low the buoyant force on the bubbles will prevail to carry the bubbles to the surface. During the upward travel the bubbles will encounter other vanes 30 which help maintain the paths of the bubbles a safe distance from the holes 28. The vanes do not have to be semi-circular but this shape has the advantages that the tooling is easy to make and that the bubbles will flow up the vane to the highest point before breaking away, thus moving to the center of the vane which is furthest from the hole and positions the bubbles favorably to be influenced by the vanes in the next rows. For the pattern of FIG. 3*b*, as the bubbles leave the center of the vane they pass between the vanes in the next row which is a region of minimal liquid flow rate thus enabling the bubbles to float nearly vertically toward the surface. In the case of the FIG. 3*a* example, bubbles leaving the top of a vane are expected to be sufficiently far from the holes to travel at least to the second row above where they receive a further boost away from the sheet 32.

It will thus be seen that the receiver dehydrator 7 is effective for liquid-gas separation for refrigerant flow in either direction so that a solid column of liquid refrigerant is presented to the TXV 8 for cooling mode and to the TXV 5 for heating mode.

The embodiments of the invention in which an exclusive property or privilege is claimed are defined as follows:

1. In a heat pump system selectably operable in heating and cooling modes wherein refrigerant flows through the system in either direction, a receiver for flow of refrigerant in either direction comprising:

a canister for receiving and dispensing refrigerant;

first and second passages leading into the canister, each passage having a mouth near the bottom of the canister for discharging refrigerant and receiving refrigerant, baffle means between the passage mouths for permitting flow of liquid refrigerant from one mouth to another and for separating vapor from the refrigerant, whereby liquid and vapor phase refrigerant flows in through one passage and liquid phase flows out through the other passage.

2. The invention as defined in claim 1 wherein the baffle means comprises a baffle and a pair of desiccant bags, each bag being positioned between the baffle and one of the mouths so that the bags assist in separating the vapor from the liquid phase.

3. The invention as defined in claim 1 wherein each passage leads through the canister near the top thereof and extends to a site near the bottom.

4. The invention as defined in claim 1 wherein each passage enters through the canister near the top thereof at one side of the baffle means and includes a curved tube crossing to the other side of the baffle and extending to a site near the bottom.

5. The invention as defined in claim 1 wherein the baffle means includes a perforated element diametrically disposed in the canister for passing liquid phase refrigerant from one mouth to another while preferentially guiding vapor phase refrigerant to the top of the canister.

* * * * *